US008373687B2

(12) United States Patent
Kwon

(10) Patent No.: US 8,373,687 B2
(45) Date of Patent: Feb. 12, 2013

(54) ORGANIC LIGHT EMITTING DISPLAY AND DRIVING METHOD THEREOF

(75) Inventor: Oh-kyong Kwon, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 858 days.

(21) Appl. No.: 12/077,828

(22) Filed: Mar. 21, 2008

(65) Prior Publication Data

US 2008/0231562 A1 Sep. 25, 2008

(30) Foreign Application Priority Data

Mar. 22, 2007 (KR) ..... 10-2007-0028166

(51) Int. Cl.
*G06F 3/038* (2006.01)
*G09G 5/00* (2006.01)

(52) U.S. Cl. ..... 345/204; 345/77

(58) Field of Classification Search ..... 345/76–102; 315/169.3

See application file for complete search history.

(56) References Cited

U.S. PATENT DOCUMENTS

| | | | | |
|---|---|---|---|---|
| 6,911,781 | B2 * | 6/2005 | Yamazaki et al. | 315/169.3 |
| 7,456,812 | B2 | 11/2008 | Smith et al. | |
| 2005/0179625 | A1 | 8/2005 | Choi et al. | |
| 2006/0139264 | A1 | 6/2006 | Choi et al. | |
| 2007/0018917 | A1 | 1/2007 | Miyazawa | |
| 2008/0001854 | A1 | 1/2008 | Hamer et al. | |
| 2008/0036703 | A1 | 2/2008 | Wang et al. | |
| 2008/0224962 | A1 | 9/2008 | Kasai et al. | |
| 2008/0252571 | A1 * | 10/2008 | Hente et al. | 345/76 |

FOREIGN PATENT DOCUMENTS

| | | | |
|---|---|---|---|
| JP | 2004-145257 | A | 5/2004 |
| JP | 2005-128272 | | 5/2005 |
| JP | 2005-258427 | | 9/2005 |
| JP | 2005-309230 | | 11/2005 |
| JP | 2006-058352 | | 3/2006 |
| JP | 2006-058352 | A | 3/2006 |
| JP | 2006-058352 | A | 4/2006 |
| JP | 2007-052202 | A | 3/2007 |
| JP | 2007-140325 | | 6/2007 |
| KR | 10-2005-0049320 | A | 5/2005 |
| KR | 10-2005-0052332 | A | 6/2005 |
| KR | 10-2006-0029062 | A | 4/2006 |
| KR | 10-2006-0112993 | A | 11/2006 |
| KR | 10-2006-0132795 | A | 12/2006 |
| KR | 10-2007-0000422 | A | 1/2007 |
| KR | 10-2007-0019882 | A | 2/2007 |

OTHER PUBLICATIONS

Office Action issued on Aug. 29, 2008 from the Korean Intellectual Property Office in Korean Patent Application No. Oct. 2007-0028166.

Korean Notice of Allowance dated Jun. 26, 2008 for Korean Application No. KR 10-2007-0035009 corresponding to U.S. Appl. No. 12/080,956, filed Apr. 8, 2008, which is related to the captioned application.

(Continued)

*Primary Examiner* — Kevin M Nguyen
*Assistant Examiner* — Kenneth B Lee, Jr.
(74) *Attorney, Agent, or Firm* — Knobbe Martens Olson & Bear LLP

(57) ABSTRACT

An organic light emitting display capable of displaying images of uniform luminance and a method for driving the display are disclosed. The display senses degradation of the organic light emitting diode and threshold and/or mobility of a drive transistor and modifies the data supplied to the pixel according to the sensed parameters.

32 Claims, 11 Drawing Sheets

OTHER PUBLICATIONS

Korean Notice of Allowance dated Jun. 26, 2008 for Korean Patent Applications No. KR 10-2007-0035012 corresponding to U.S. Appl. No. 12/080,955, filed Apr. 8, 2008, which is related to the captioned application.

Office Action dated Aug. 17, 2011 for U.S. Appl. No. 12/080,956, filed Apr. 8, 2008, which is related to captioned U.S. Appl. No. 12/077,828.

Office Action dated Aug. 4, 2011 for U.S. Appl. No. 12/082,147, filed Apr. 8, 2008, which is related to captioned U.S. Appl. No. 12/077,828.

Office Action dated Aug. 10, 2011 for U.S. Appl. No. 12/080,955, filed Apr. 8, 2008, which is related to captioned U.S. Appl. No. 12/077,828.

Office Action dated Apr. 25, 2012 for U.S. Appl. No. 12/080,955, filed April 8, 2008, which is related to captioned U.S. Appl. No. 12/077,828.

Korean Office Action dated Aug. 29, 2008 for Korean Patent Application No. KR 10-2007-0035011 corresponding to U.S. Appl. No. 12/082,147, filed Apr. 8, 2008, which is related to the captioned application.

* cited by examiner

ORGANIC LIGHT EMITTING DISPLAY AND DRIVING METHOD THEREOF

CROSS-REFERENCE TO RELATED APPLICATIONS

This application claims the benefit of Korean Patent Application No. 10-2007-0028166, filed on Mar. 22, 2007, in the Korean Intellectual Property Office, the disclosure of which is incorporated herein by reference.

BACKGROUND

1. Field

The field relates to an organic light emitting display and a driving method thereof, and more particular to an organic light emitting display and a driving method thereof, which may display images of uniform luminance regardless of degradation of an organic light emitting diode and a threshold voltage and/or mobility of a drive transistor.

2. Discussion of Related Technology

Recently, various flat plate displays having reduced weight and volume when compared to cathode ray tubes (CRT) have been developed. Flat panel displays may take the form of liquid crystal displays (LCD), field emission displays (FED), plasma display panels (PDP), and organic light emitting displays.

Among the flat panel displays, the organic light emitting displays make use of organic light emitting diodes that emit light by re-combination of electrons and holes. The organic light emitting display has advantages of high response speed and small power consumption.

FIG. 1 is a circuit diagram showing a pixel 4 of a conventional organic light emitting display.

With reference to FIG. 1, the pixel 4 includes an organic light emitting diode OLED and a pixel circuit 2. The pixel circuit 2 is coupled to a data line Dm and a scan line Sn, and controls the organic light emitting diode OLED.

An anode electrode of the organic light emitting diode OLED is coupled to pixel circuit 2, and a cathode electrode thereof is coupled to a second power supply ELVSS. The organic light emitting diode OLED generates light of a luminance corresponding to an electric current from the pixel circuit 2.

When a scan signal is supplied to the scan line Sn, the pixel circuit 2 controls an amount of an electric current provided to the organic light emitting diode OLED according to a data signal provided to the data line Dm. So as to do this, the pixel circuit 2 includes a second transistor M2, a first transistor M1, and a storage capacitor Cst. The second transistor M2 is coupled between a first power supply ELVDD and the organic light emitting diode OLED. The first transistor M1 is coupled between the data line Dm and the scan line Sn. The storage capacitor Cst is coupled between a gate electrode and a first electrode of the second transistor M2.

The gate electrode of the first transistor M1 is coupled to the scan line Sn, and a first electrode thereof is coupled to the data line Dm. A second electrode of the first transistor M1 is coupled with one terminal of the storage capacitor Cst. Here, the first electrode is a source electrode or a drain electrode, and the second electrode is the electrode different from the first electrode. For example, when the first electrode is the source electrode, the second electrode is the drain electrode. When supplied with a scan signal, the first transistor M1 coupled with the scan line Sn and the data line Dm is turned-on to provide a data signal from the data line Dm to the storage capacitor Cst. The storage capacitor Cst is then charged with a voltage corresponding to the data signal.

The gate electrode of the second transistor M2 is coupled to one terminal of the storage capacitor Cst, and a first electrode thereof is coupled to another terminal of the storage capacitor Cst and a first power supply ELVDD. Further, a second electrode of the second transistor M2 is coupled with an anode electrode of the organic light emitting diode OLED. The second transistor M2 controls an electric current flowing from the first power supply ELVDD to a second power supply ELVSS through the organic light emitting diode OLED according to the voltage charged in the storage capacitor Cst. Here, the organic light emitting diode OLED generates light corresponding to the electric current supplied from the second transistor M2.

The conventional organic light emitting display can not display the images of desired luminance due to degradation of the organic light emitting diode OLED. In practice, as time goes by, the organic light emitting diode OLED is degraded, and accordingly light of lower luminance is gradually generated despite the same data signal. Additionally, the images of desired luminance can not be conventionally displayed due to a non-uniformity of the threshold voltage of the drive transistor M2 in each of the pixels.

SUMMARY OF CERTAIN INVENTIVE ASPECTS

One aspect is an organic light emitting display, including a plurality of pixels disposed near intersections of data lines, scan lines, and emission control lines. The display also includes a scan driver configured to supply a scan signal to the scan lines and to supply an emission control signal to the emission control lines, a control line driver configured to supply a control signal to control lines, a data driver configured to generate data signals for the data lines, and a sensing unit configured to sense degradation information of an organic light emitting diode and a and threshold voltage and/or mobility information of a drive transistor included in each of the pixels. The display also includes a switch unit configured to connect one of the sensing unit and the data driver to the data lines, a control block configured to store the sensed degradation information and the sensed threshold voltage and/or mobility information, and a timing controller configured to generate second data based on first data from another circuit, the sensed degradation information, and the sensed threshold voltage and/or mobility information.

Another aspect is a method of driving an organic light emitting display. The method includes generating a first voltage while sinking a first electric current through a drive transistor in one of a plurality of pixels, converting the first voltage into a first digital value, storing the first digital value in a memory, generating a second voltage while supplying a second electric current to an organic light emitting diode in the one pixel, converting the second voltage into a second digital value, storing the second digital value in the memory, and generating second data based on first data received from another circuit, the first digital value and the second digital value, where the second data has more bits than the first data value.

BRIEF DESCRIPTION OF THE DRAWINGS

These and/or other aspects and advantages will become apparent and more readily appreciated from the description of certain embodiments, taken in conjunction with the accompanying drawings of which.

DETAILED DESCRIPTION OF CERTAIN INVENTIVE EMBODIMENTS

Figure 1:
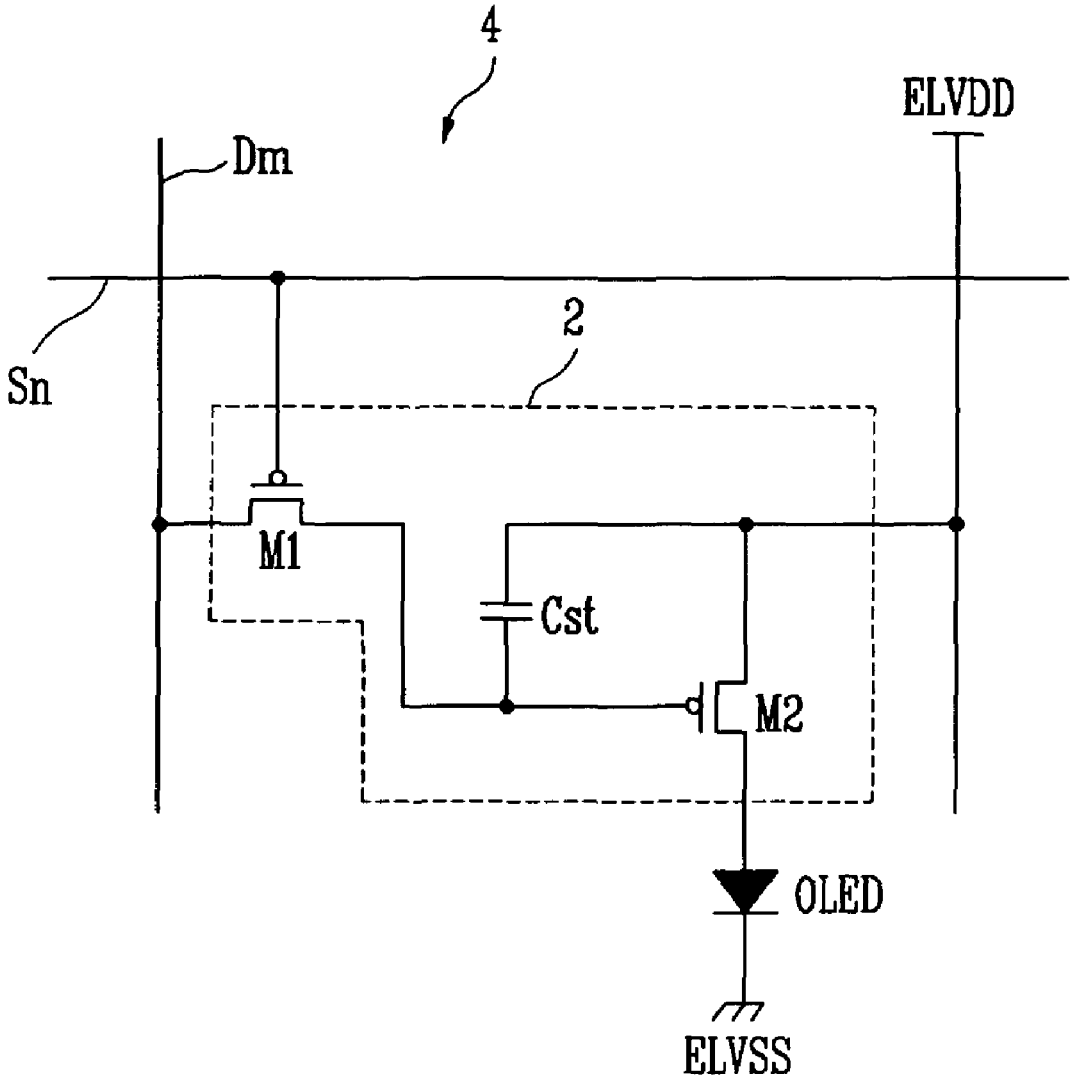
FIG. 1 is a circuit diagram showing a pixel.

Hereinafter, certain embodiments will be described with reference to the accompanying drawings. When one element is connected to another element, the one element may be not only directly connected to another element but also indirectly connected to another element via a third element. Further, irrelative elements may be omitted for clarity. Also, like reference numerals generally refer to like elements throughout.

Figure 2:
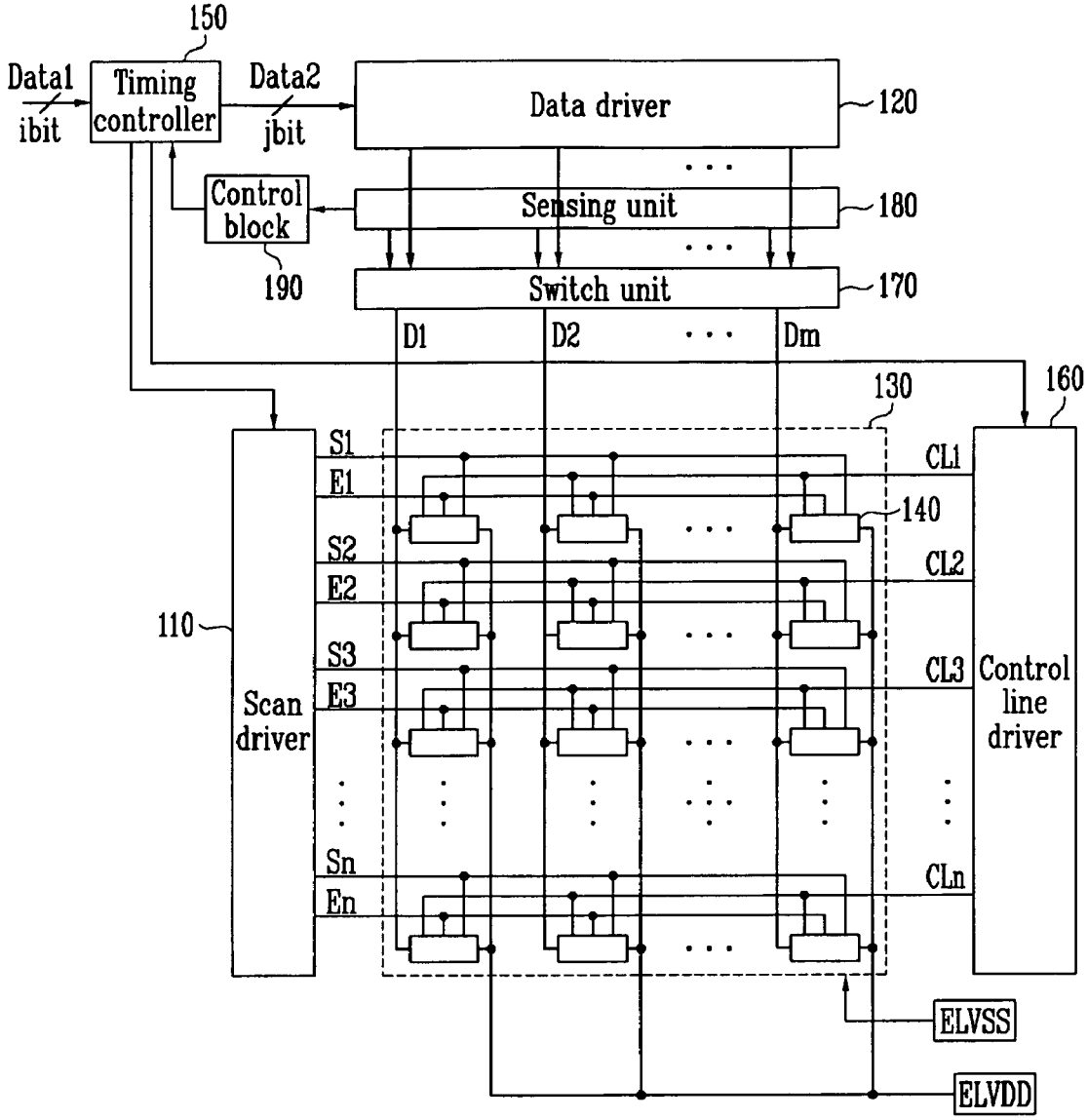
FIG. 2 is a view showing an organic light emitting display according to one embodiment.

FIG. 2 is a view showing an organic light emitting display according to one embodiment.

With reference to FIG. 2, the organic light emitting display according to one embodiment includes a pixel portion 130, a scan driver 110, a control line driver 160, a data driver 120, and a timing control unit 150. The pixel portion 130 includes a plurality of pixels 140, which are coupled with scan lines S1 to Sn, emission control lines E1 to En, and data lines D1 to Dm. The scan driver 110 drives the scan lines S1 to Sn and the emission control lines E1 to En. The control line driver 160 drives the control lines CL1 to CLn. The data driver 120 drives the data lines D1 to Dm. The timing control unit 150 controls the scan driver 110, the data driver 120, and the control line driver 160.

Also, the organic light emitting display further includes a sensing unit 180, a switch unit 170, and a control block 190. The sensing unit 180 senses and extracts degradation information of an organic light emitting diode and threshold voltage information of a drive transistor. The switch unit 170 selectively connects the sensing unit 180 and the data driver 120 with the data lines D1 to Dm. The control block 190 stores the information sensed by the sensing unit 180.

The pixel portion 130 includes pixels 140, which are disposed near intersections of the scan lines S1 to Sn, the emission control lines E1 to En, and the data lines D1 to Dm. The pixels 140 receive power of a first power supply ELVDD and power of a second power supply ELVSS. The pixels 140 controls an electric current from the first power supply ELVDD to the second power supply ELVSS through an organic light emitting diode. Accordingly, the organic light emitting diode generates light of luminance according to the current.

The scan driver 110 sequentially supplies a scan signal to the scan lines S1 to Sn according to the timing control unit 150. The scan driver 110 further supplies an emission control signal to the emission control lines E1 to En according to the timing control unit 150.

The control line driver 160 sequentially supplies a control signal to the control lines CL1 to CLn according to the timing control unit 150.

The data driver 120 supplies a data signal to the data lines D1 to Dm according to the timing control unit 150.

The switch unit 170 selectively connects the sensing unit 180 and the data driver 120 to the data lines D1 to Dm. To do this, the switch unit 170 includes at least one switching element, which is coupled to each of the data lines D1 to Dm, respectively, i.e., every channel.

The sensing unit 180 extracts degradation information of the organic light emitting diode included in each of the pixels 40, and provides the degradation information to the control block 190. Further, the sensing unit 180 extracts threshold voltage and/or mobility information of the drive transistor included in each of the pixels 40, and provides the extracted information to the control block 190. In order to do this, the sensing unit 180 includes sensing circuits, which are coupled with the data lines D1 to Dm, respectively, i.e., every channel.

The control block 190 stores the degradation information from the sensing unit 180 for each of the pixels. To do this, the control block 190 includes a memory and a controller. The controller transfers information stored in the memory to the timing control unit 150.

The timing controller 150 controls the data driver 120, the scan driver 110, and the control line driver 160. Further, the timing controller 150 changes the value of a first data Data1 from another circuit to generate a second data Data2. The first data Data1 is image data for illuminating the display. Here, the first data Data1 has i (i is a natural number) bits, and the second data Data2 has j (j is a natural number greater than i) bits.

The second data Data2 generated by the timing controller 150 is provided to the data driver 120. Accordingly, the data driver 120 generates a data signal using the second data Data2, and provides the data signal to the pixels 140, which emit light according to the second data Data2.

Figure 3:
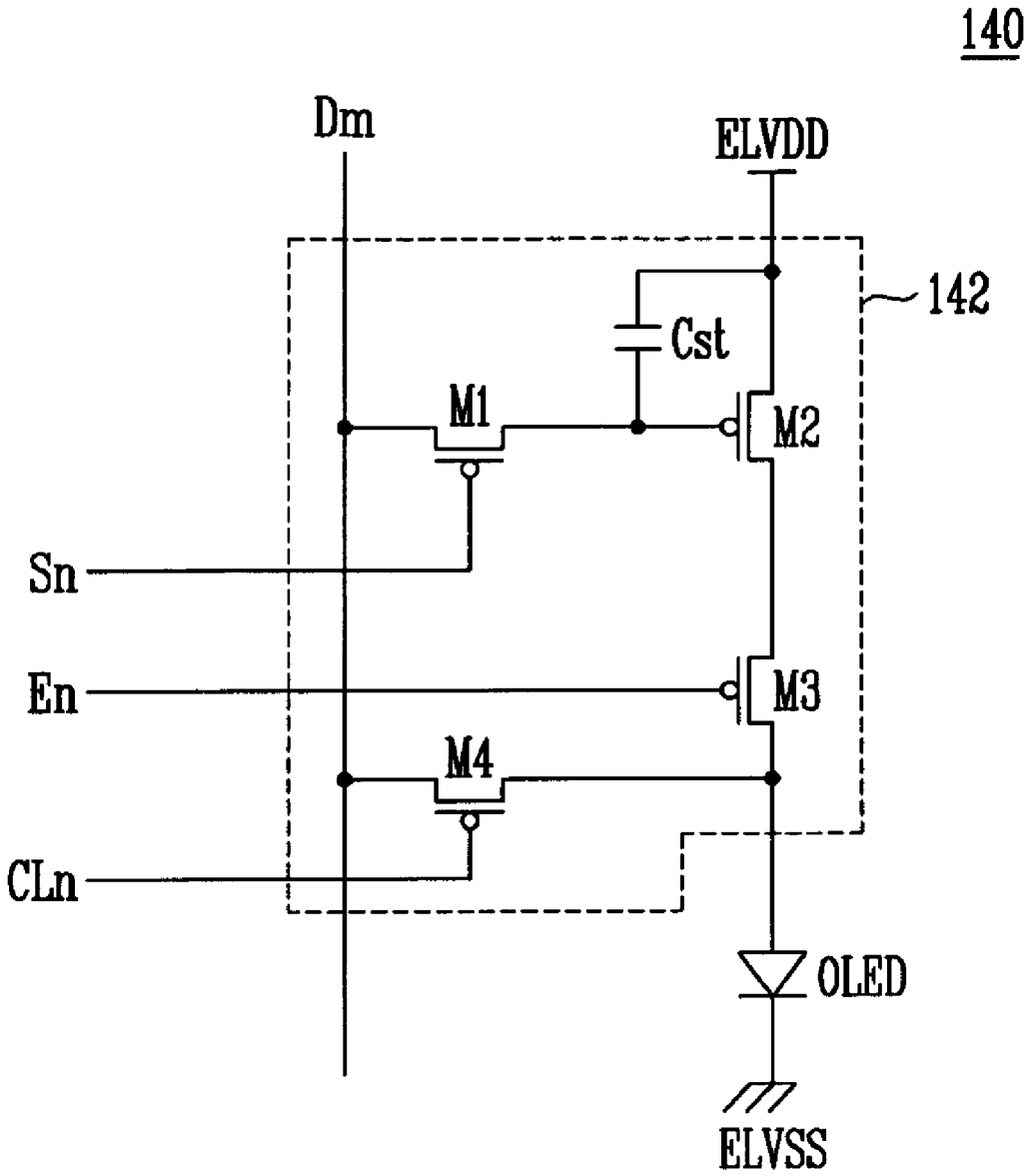
FIG. 3 is a circuit diagram showing an embodiment of a pixel.

FIG. 3 is a circuit diagram showing an embodiment of the pixel shown in FIG. 2. For convenience of a description, FIG. 3 shows a pixel coupled with an m-th data line Dm and an n-th scan line Sn.

With reference to FIG. 3, the pixel 140 includes an organic light emitting diode OLED and a pixel circuit 142. The pixel circuit 142 supplies an electric current to the organic light emitting diode OLED.

An anode electrode of the organic light emitting diode OLED is connected to the pixel circuit 142, and a cathode electrode thereof is connected to the second power supply ELVSS. The organic light emitting diode OLED generates light having luminance corresponding to an electric current from the pixel circuit 142.

When the scan signal is supplied to the scan line Sn, the pixel circuit 142 receives the data signal from the data line Dm. Further, when a control signal is supplied to the control line CLn, the pixel circuit 142 provides at least one of the degradation information of the organic light emitting diode OLED and the threshold voltage and/or mobility information of the drive transistor M2 to the sensing unit 180. To do this, the pixel circuit 142 includes four transistors M1 to M4 and a storage capacitor Cst.

A gate electrode of the first transistor M1 is coupled to a scan line Sn, and a first electrode thereof is coupled with a data line Dm. Further, a second electrode of the first transistor M1 is coupled to a first terminal of the storage capacitor Cst. When the scan signal is supplied to the scan line Sn, the first transistor M1 is turned on. As a result, the scan signal is supplied during a sensing period of the threshold voltage and/or mobility information of the second transistor M2 and a storage period of the data signal in the storage capacitor Cst.

A gate electrode of the second transistor M2 is coupled with a first terminal of the storage capacitor Cst, and a first electrode thereof is coupled to a second terminal of the storage capacitor Cst. The second transistor M2 controls an electric current flowing from the first power supply ELVDD to the second power supply ELVSS through the organic light emitting diode OLED according to a voltage value stored in the storage capacitor Cst. Here, the organic light emitting diode OLED generates light corresponding to the current supplied from the second transistor M2.

A gate electrode of the third transistor M3 is coupled to the emission control line En, and a first electrode thereof is coupled to a second electrode of the second transistor M2. Further, a second electrode of the third transistor M3 is coupled with the organic light emitting diode OLED. When an emission control signal is supplied to the emission control line En, the third transistor M3 is turned-off. In contrast, when the emission control signal is not supplied to the emission control line En, the third transistor M3 is turned-on. The emission control signal is supplied while the voltage corresponding to the data signal is stored in the storage capacitor Cst and while the degradation information in the organic light emitting diode OLED is sensed.

The gate electrode of the fourth transistor M4 is coupled with the control line CLn, and a first electrode thereof is coupled to a second electrode of the third transistor M3. Further, a second electrode of the fourth transistor M4 is coupled with the data line Dm. When a control signal is supplied to the control line CLn, the fourth transistor M4 is turned-on. Otherwise, the fourth transistor M4 is turned-off. The control signal is supplied while the degradation information in the organic light emitting diode OLED is sensed and while the threshold voltage and/or mobility information in the second transistor M2 is sensed.

Figure 4:
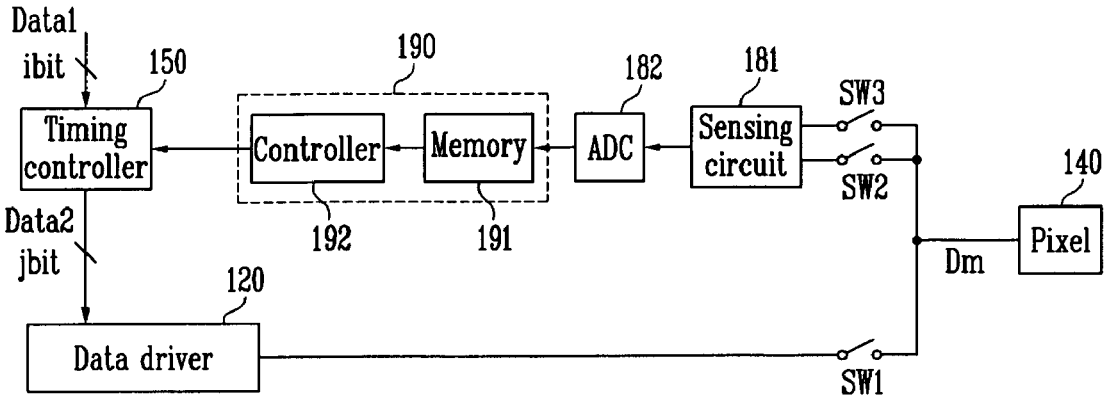
FIG. 4 is a view showing a switch unit, a sensing unit, and a control block.

FIG. 4 is a view showing a switch unit, a sensing unit, and a control block shown in FIG. 2. For convenience of the description, FIG. 4 shows the switch unit, the sensing unit, and the control block, coupled with the m-th data line.

With reference to FIG. 4, three switching elements SW1 to SW3 are provided at each channel. Each channel of the sensing unit 180 includes a sensing circuit 181 and an analog-digital converter ADC 182. Further, the control block 190 includes a memory 191 and a controller 192.

The first switching element SW1 is disposed between the data driver 120 and the data line Dm. When supplied with the data signal from the data driver 120, the first switching element SW1 is turned-on. That is, the first switching element SW1 maintains a turned-on state while the organic light emitting display displays an image.

Figure 5:
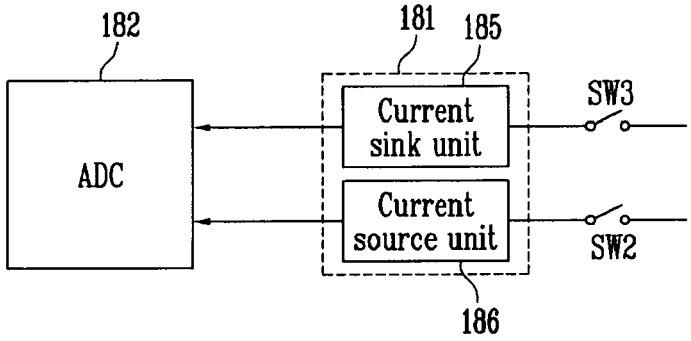
FIG. 5 is a view showing an embodiment of a sensing circuit shown in FIG. 4.

As shown in FIG. 5, the sensing circuit 181 includes a current sink unit 185 and a current source unit 186.

When a third switching element SW3 is turned-on, the current sink unit 185 sinks a first electric current, and applies a voltage to the ADC 182. The first electric current is sunk through the second transistor M2 included in the pixel 140. Accordingly, a first voltage generated by the current sink unit 185 has threshold voltage and/or mobility information of the second transistor M2. In addition, the current value of the first electric current is variously set so that the voltage can be applied at a certain time. For example, the first electric current may be applied to the organic light emitting diode OLED when light of the greatest luminance is emitted.

When a second switching element SW2 is turned-on, the current source unit 186 sources a second electric current, and applies a second voltage to the ADC 182. Here, the second electric current is sourced through the organic light emitting diode OLED included in the pixel 140. Accordingly, the second voltage generated by the current source unit 186 has degradation information of the organic light emitting diode OLED.

As the organic light emitting diode is degraded, the resistance value thereof is changed. The value of the second voltage changes according to the degradation of the organic light emitting diode OLED. This allows for the degradation information of the organic light emitting diode OLED to be extracted. The value of the second electric current may be experimentally determined. For example, the second electric current can be set to have the same value as that of the first electric current.

The ADC 182 converts a first voltage supplied from the sensing circuit 181 into a first digital value and converts a second voltage into a second digital value.

The control block 190 includes a memory 191 and a controller 192.

The memory 191 stores the first digital value and the second digital value supplied from the ADC 182. The memory 191 stores a threshold voltage and/or mobility of the second transistor M2 and degradation information of an organic light emitting diode OLED for each of the pixels 140 of the pixel portion 130.

The controller 192 transfers the first digital value and the second digital value stored in the memory 191 to the timing controller 150. The controller 192 then transfers the first digital value and the second digital value extracted from a pixel 140, for which a first data Data1 is input to the timing controller 150.

The timing controller 150 receives the first data Data1 from another circuit, and the first and second digital values from the controller 192. When the timing controller 150 receives the first and second digital values, it changes the value of the first data Data1 to generate a second data Data2, where the second data Data2 has been adjusted to compensate for the sensed transistor and diode parameters. The second data Data2 is supplied to the pixel 140 so that an image of proper luminance may be displayed.

For example, in the timing controller 150, the value of the second data Data2 may be higher than the first data Data1 because of the second digital value representing the degradation of the organic light emitting diode. Accordingly, the second data Data2, in which degradation information of the organic light emitting diode OLED is reflected, is generated. As the organic light emitting diode OLED is degraded, light of lower luminance is generated for a constant data value. By generating the second data Data2 the light of accurate luminance is generated. Further, the timing controller 150 generates a second data Data2 based on the first digital value in order to compensate for variation in threshold voltage and/or mobility of the second transistor M2. This causes images of uniform luminance to be displayed across the pixel portion 130 regardless of the variation in threshold voltage and/or mobility of the second transistors M2.

The data driver 120 generates a data signal using the second data Data2 and provides the data signal to a pixel 140.

Figure 6:
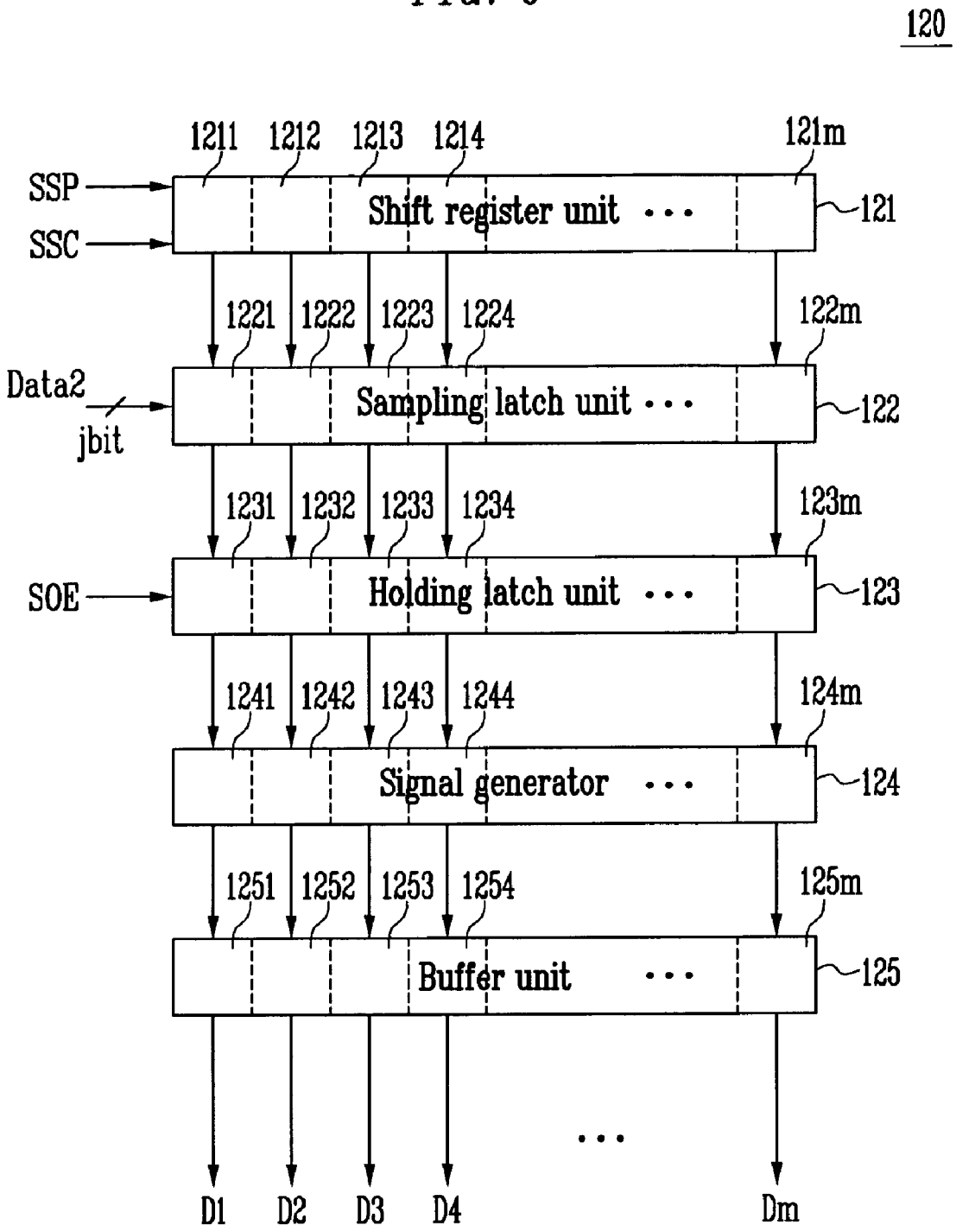
FIG. 6 is a view showing an example of a data driver shown in FIG. 2.

FIG. 6 is a view showing an example of a data driver shown in FIG. 2.

With reference to FIG. 6, the data driver includes a shift register unit 212, a sampling latch unit 122, a holding latch unit 123, a signal generator 124, and a buffer unit 125.

The shift register unit 121 receives a source start pulse SSP and a source shift clock SSC from the timing controller 150. The shift register unit 121 having received the source start pulse SSP and the source shift clock SSC shifts the source start pulse SSP every single period of the source shift clock SSC to sequentially generate m sampling signals. To do this, the shift register unit 121 includes m shift registers 1211 to 121m.

The sampling latch unit 122 sequentially stores second data Data2 in response to sampling signals sequentially supplied from the shift register unit 121. To do this, the sampling latch unit 122 includes m sampling latches 1221 to 122m in order to store the second m data Data2.

The holding latch unit 123 receives a source output enable signal SOE from the timing controller 150. The holding latch unit 123 having received the source output enable signal SOE receives and stores the second data Data2 from the sampling latch unit 122. Further, the holding latch unit 123 supplies the second data Data2 stored therein to the signal generator 124. So as to do this, the holing latch unit 123 includes m holding latches 1231 to 123m.

The signal generator 124 receives the second data Data2 from the holing latch unit 123, and generates m data signals corresponding the second data Data2. In order to do this, the signal generator 124 includes m digital-analog converters (referred to as 'DACs' hereinafter) (1241 to 124m). Namely, the signal generator 124 generates m data signals using DACs 1241 to 124m disposed in every channel, and provides them to the buffer unit 125.

The buffer unit 125 supplies the m data signals from the signal generator 124 to m data lines D1 to Dm, respectively. In order to do this, the buffer unit 125 includes m buffers 1251 to 125m.

FIG. 7*a* to FIG. 7*d* are waveform diagrams showing driving waveforms supplied to the pixel and the switch unit.

Figure 7A:
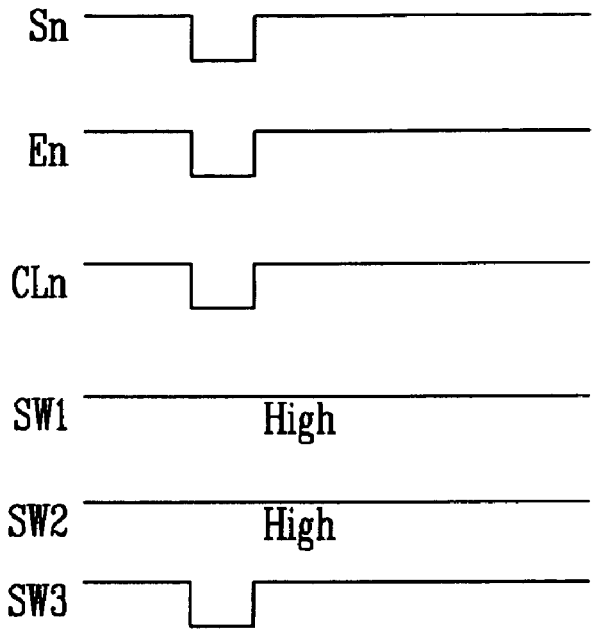
FIG. 7*a* to FIG. 7*d* are waveform diagrams showing driving waveforms supplied to the pixel and the switch unit.

FIG. 7*a* shows a waveform that senses a threshold voltage and/or mobility of the second transistor M2 included in the pixels 140. During a period of sensing the threshold voltage and/or mobility of the second transistor M2, the scan driver 110 sequentially supplies a scan signal to the scan lines S1 to Sn. Further, the scan driver 110 controls a supply of an emission control signal so as not to supply the emission control signal to a k (k is a natural number)-th emission control line Ek when the scan signal is supplied to a k-th scan line Sk.

In addition, the control line driver 160 sequentially supplies a control signal to the control lines CL1 to CLn synchronously with the scan signal. Also, during the sensing of the threshold voltage and/or mobility of the second transistor M2, the third switching element SW3 is on.

Figure 8:
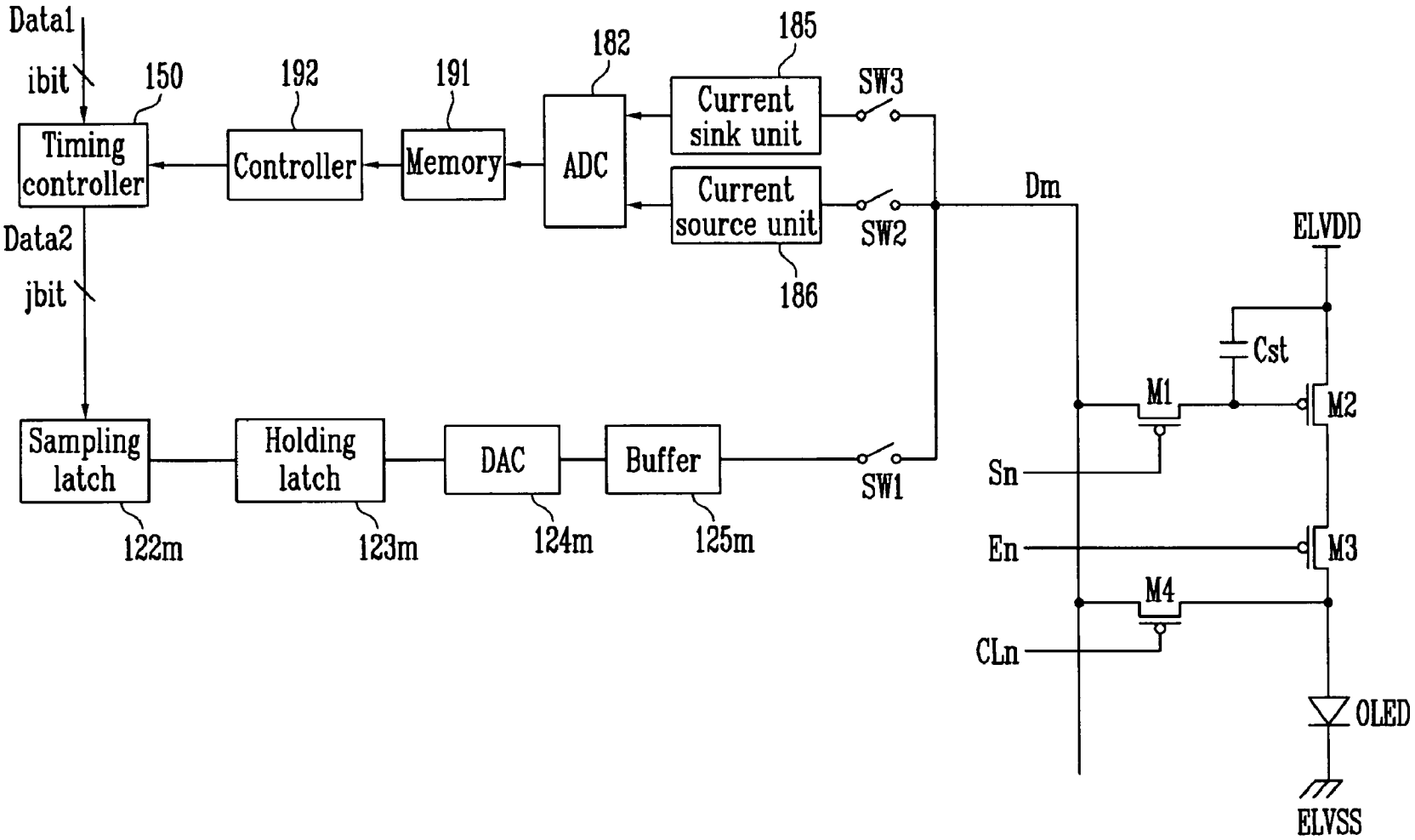
FIG. 8 is a view showing a connection structure of the data driver, the timing controller, the control block, the sensing unit, a switch unit, and the pixel.

The following is an operation with reference to FIG. 7*a* and FIG. 8. When a scan signal is supplied to the scan line Sn, the first transistor M1 is turned-on. When the first transistor M1 is turned-on, a gate electrode of the second transistor M2 is electrically coupled to the data line Dm.

Furthermore, the fourth transistor M4 is turned-on according to a control signal supplied to the control line CLn. In addition, because the emission control signal is not supplied to the emission control line En, the third transistor M3 is turned-on. When the third transistor M3 is turned-on, a second electrode of the second transistor M2 is electrically coupled with the data line Dm through the fourth transistor M4.

The current sink unit 185 sinks the first electric current from a first power supply ELVDD through the third switching element SW3, the fourth transistor M4, the third transistor M3, and the second transistor M2 of the active pixel 140. When the current sink unit 185 sinks the first electric current, a first voltage is applied to the current sink unit 185. Because the first electric current is sunk through the second transistor M2, the first voltage includes the threshold voltage and/or mobility information of the second transistor M2. Because the second transistor M2 is effectively diode connected, the voltage applied to the gate electrode of the second transistor M2 is also the first voltage.

The ADC 182 converts the first voltage to a first digital value and supplies the first digital value to the memory 191, and the first digital value is stored in the memory 191. Through the aforementioned operation, the first digital value having threshold voltage and/or mobility information of the second transistor M2 included in each of the pixels 140 is stored in the memory 191.

A procedure of sensing the threshold voltage and/or mobility of the second transistor M2 may be performed at least once prior to operating the organic light emitting display. For example, during production testing of the organic light emitting display, the threshold voltage of the second transistor M2 may be sensed and stored in the memory 191. Further, the procedure of sensing the threshold voltage and/or mobility of the second transistor M2 can be performed as a result of a signal applied after the unit is sold.

Figure 7B:
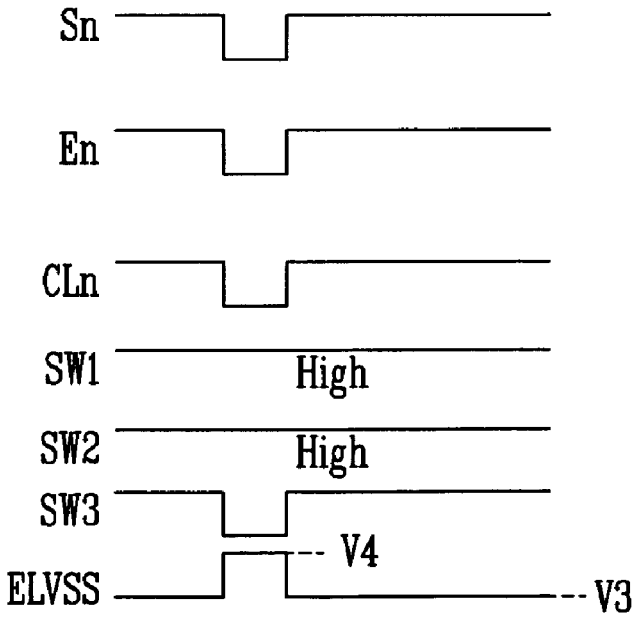

As shown in FIG. 7*b*, during a period of sensing the threshold voltage and/or mobility of the second transistor M2, a voltage of the second power supply ELVSS can be increased from a third voltage V3 to a fourth voltage V4. When the voltage of the second power supply ELVSS is increased to the fourth voltage V4, it may prevent the electric current sunk by the current sink unit 185 from being supplied to the organic light emitting diode OLED.

Figure 7C:
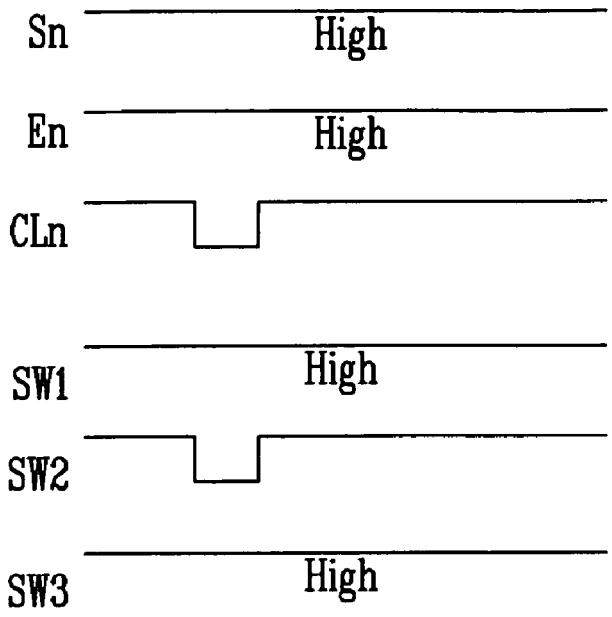

FIG. 7*c* shows a timing chart for a procedure that senses degradation information of the organic light emitting diode included in the pixels.

During a period of sensing the degradation information of the organic light emitting diode OLED, the control line driver 160 sequentially supplies a control signal to the control lines CL1 to CLn. Further, during a period of sensing degradation information of the organic light emitting diode OLED, the second switching element SW2 is on.

In the operation with reference to FIG. 7*c* and FIG. 8, when the control signal is supplied to the control line CLn, the fourth transistor M4 is turned on. When the fourth transistor M4 is turned on, the organic light emitting diode OLED is electrically coupled with the data line Dm.

Accordingly, the second electric current supplied from the current source unit 186 is provided to the organic light emitting diode OLED through the second switching element SW2 and the fourth transistor M4. When the second electric current is supplied, the current source unit 186 senses a second voltage applied to the organic light emitting diode OLED, and provides the second sensed voltage to the ADC 182.

The ADC 182 converts the second voltage from the current source unit 186 into a second digital value, supplies the second digital value to the memory 191, and the second digital value is stored in the memory 191. Through the aforementioned operation, the second digital value having degradation information of the organic light emitting diode OLED for each of the pixels 140 is stored in the memory 191.

The foregoing procedure of sensing the degradation information of the organic light emitting diode OLED may be initiated at various times. For example, each time power is supplied to the organic light emitting display, the degradation information of the organic light emitting diode OLED can be sensed.

Figure 7D:
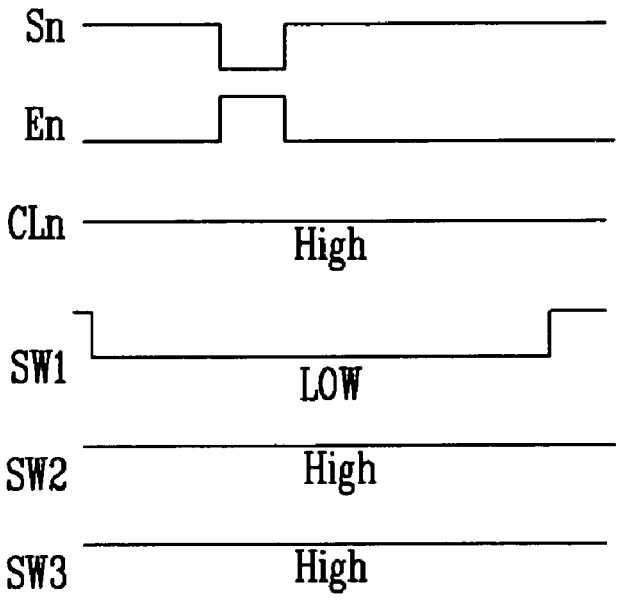

FIG. 7*d* shows a waveform for performing a normal display operation.

During a normal display operation period, the scan driver 110 sequentially supplies the scan signal to the scan lines S1 to Sn, and sequentially supplies an emission control signal to the emission control lines E1 to En. Also, during a normal display period, the first switching element SW1 is on, and the fourth transistor M4 is off.

In the operation with reference to FIG. 7*d* and FIG. 8, a first data Data1 containing image information is provided to the timing controller 150. The controller 192 provides the first digital value and the second digital value extracted from the pixel 140 to the timing controller 150.

The timing controller 150 having received the first digital value and the second digital value generates a second data Data2. Here, the second data Data2 is set so that the degradation of the organic light emitting diode OLED and the threshold voltage and/or mobility of the drive transistor M2 may be compensated for.

For example, when the first data Data1 of "00001110" is input, the timing controller 150 can generate the second data Data2 of "100001110" so as to compensate for at least one of the degradation of the organic light emitting diode OLED and variation in the threshold voltage and/or mobility of the drive transistor M2. As a result, a data signal for displaying images of correct luminance is generated as the second data Data2, and the degradation of the organic light emitting diode OLED and variation in the threshold voltage and/or mobility of the drive transistor M2 can be compensated for.

The second data Data2 generated by the timing controller 150 is provided to the DAC 124*m* through a sampling latch 122*m* and a holding latch 123*m*. Accordingly, the DAC 124*m* generates a data signal using the second data Data2, and provides the data signal to a data line Dm through a buffer 125*m*.

Because the scan signal is supplied to the scan line to turn-on the first transistor M1, the data signal supplied to the data line Dm is provided to the gate electrode of the second transistor M2. As a result, the storage capacitor Cst is charged with a voltage corresponding the data signal. During the period of charging the storage capacitor Cst, the third transistor M3 is turned off according to an emission control signal supplied to the emission control line En. This may prevent unnecessary current from being supplied to the organic light emitting diode OLED.

Next, a supply of the scan signal stops to turn off the first transistor M1, and a supply of the emission control signal stops to turn on the third transistor M3. At this time, the second transistor M2 supplies an electric current corresponding to the voltage charged in the storage capacitor Cst to the organic light emitting diode OLED. Accordingly, the organic light emitting diode OLED generates light of luminance corresponding to the electric current supplied thereto.

Because the electric current supplied to the organic light emitting diode OLED compensates for the degradation of the organic light emitting diode OLED and the threshold voltage and/or mobility of the second transistor M2, images of desired luminance and uniformity are displayed.

In the embodiment discussed with reference to FIG. 7*c* the degradation information of the organic light emitting diode OLED is stored in the memory when a display is turned on. However, the present invention is not limited thereto. For example, as shown in FIG. 9, the degradation information of the organic light emitting diode OLED can be sensed in real time during the normal display operation.

Figure 9:
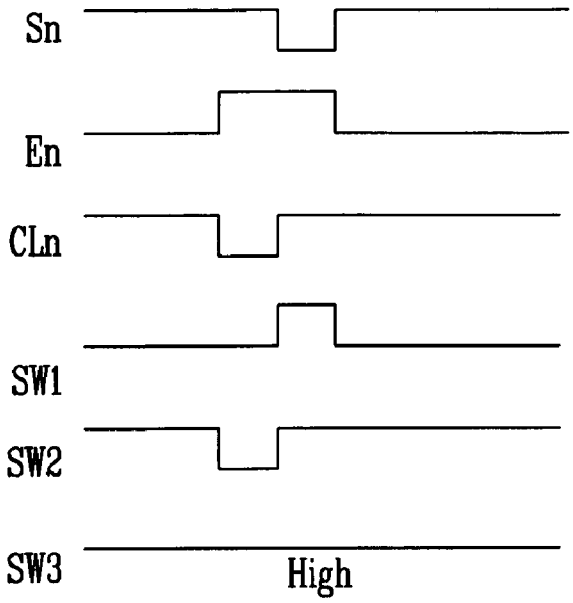
FIG. 9 is a view showing another embodiment of a driving waveform supplied to the pixel and the switch unit.

In the operation with reference to FIG. 8 and FIG. 9, prior to supplying the scan signal to the scan line Sn, an emission control signal is supplied to an emission control line En and a control signal is supplied to a control line CLn. Further, the second switching element SW2 is turned-on.

When the emission control signal is supplied to the emission control line En, the third transistor M3 is turned off. When the control signal is supplied to the control line CLn, the fourth transistor M4 is turned on. In this case, the second electric current supplied from the current source unit 186 is provided to the organic light emitting diode OLED through the fourth transistor M4. Accordingly, the second voltage is generated corresponding to the second electric current supplied to the organic light emitting diode OLED. The second voltage is stored in the memory 191 through the ADC 182.

Next, the control signal to the control line CLn stops to turn off the second switching element SW2. Further, the scan signal to the scan line Sn stops to turn-on the first switching element SW1. When the scan signal is supplied to the scan line Sn, the data signal supplied from the buffer 125m to the data line Dm is provided to the gate electrode of the second transistor M2. Accordingly, the storage capacitor Cst is charged with a voltage corresponding to the data signal.

After the storage capacitor Cst is charged with the voltage corresponding to the data signal, the scan signal stops, thereby turning-off the first transistor M1. Also, a supply of the emission control signal stops to turn on the third transistor M3. When the third transistor M3 is turned on, an electric current supplied from the second transistor M2 is provide to the organic light emitting diode OLED, so that images of desired luminance are displayed.

In the waveform of the FIG. 9, before the scan signal is supplied to the scan line Sn, the control signal is supplied to the control line CLn, so that the degradation information of the organic light emitting diode OLED is stored in the memory 191. Here, degradation information extracted and stored in the memory 191 during an i-th (i is a natural number) frame period is used to generate the second data Data2 during an (i+1)-th frame period.

Figure 10:
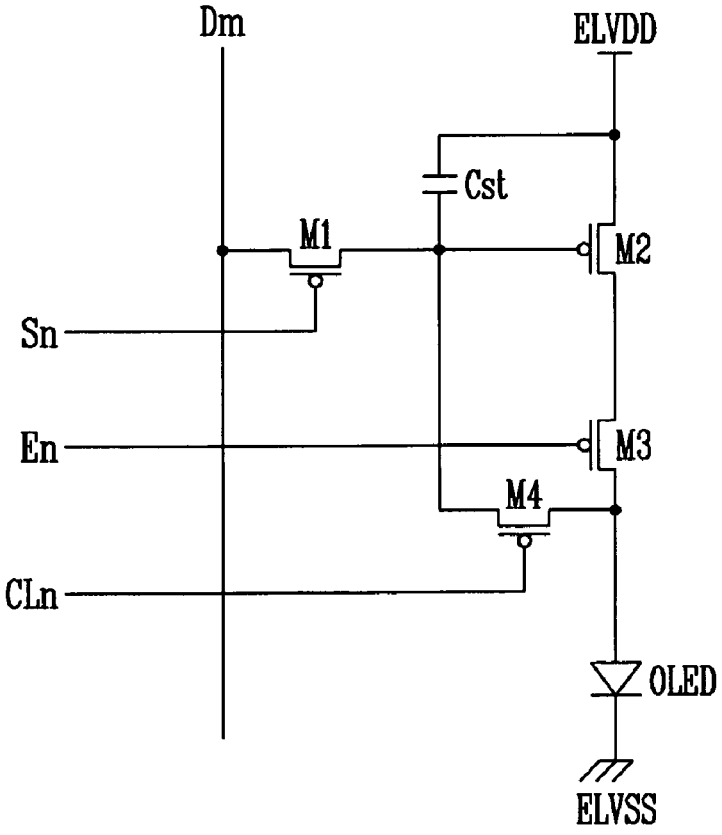
FIG. 10 is a circuit diagram showing another embodiment of a pixel.

FIG. 10 is a circuit diagram showing another embodiment of the pixel shown in FIG. 2. For convenience of the explanation, FIG. 10 shows a pixel coupled with an m-th data line Dm and an n-th scan line Sn. Parts in the pixel of FIG. 10 corresponding to those of the pixel of FIG. 3 are generally designated by the same symbols.

With reference to FIG. 10, the fourth transistor M4 in pixel 140 is disposed between an anode electrode of the organic light emitting diode OLED and a gate electrode of the second transistor M2. The fourth transistor M4 is turned on during a period of measuring the degradation information of the organic light emitting diode OLED and during a period of measuring the threshold voltage and/or mobility of the second transistor M2.

Although the fourth transistor M4 is turned on, the organic light emitting diode OLED is not electrically coupled to the data line Dm. The remaining driving procedures are similar to that of the pixel shown in FIG. 3.

During a period of sensing the threshold voltage and/or mobility information of the second transistor M2, a waveform shown in FIG. 7*a* or FIG. 7*b* may be supplied. Further, while the pixel 140 is normally driven, a waveform shown in FIG. 7*d* may be supplied.

Figure 11A:
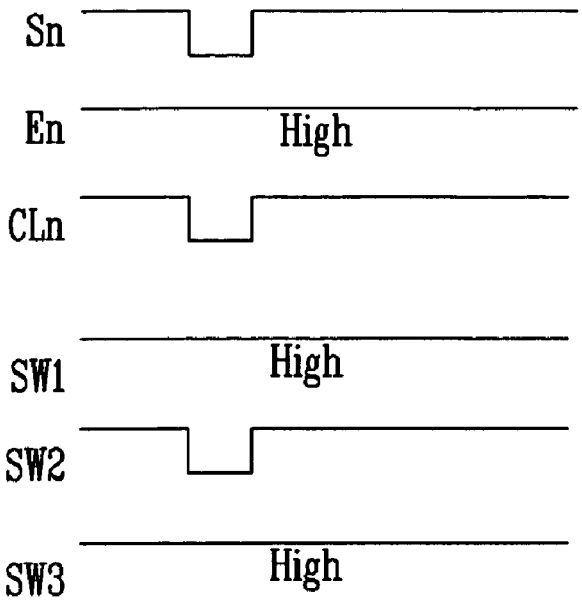
FIG. 11*a* to FIG. 11*b* are waveform diagrams showing driving waveforms supplied to the pixel and the switch unit shown in FIG. 10.
Figure 11B:
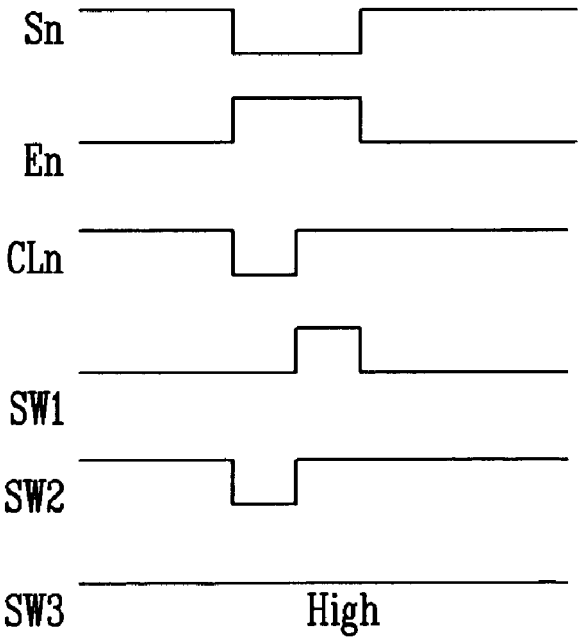

During the period of sensing the degradation information of the organic light emitting diode OLED, a waveform shown in FIG. 11*a* may be supplied. FIG. 11*a* to FIG. 11*b* are waveform diagrams showing driving waveforms supplied to the pixel and the switch unit shown in FIG. 10.

With reference to FIG. 11*a*, the scan signal is supplied to the scan line Sn to turn-on the first transistor M1, and a control signal is supplied to the control line CLn to turn-on the fourth transistor M4. Moreover, during the period of sensing the degradation information of the organic light emitting diode OLED, the second switching element SW2 maintains a turning-on state.

Accordingly, the second electric current from the current source unit 186 is supplied to the organic light emitting diode OLED through the first transistor M1 and the fourth transistor M4. The second voltage generated is stored in the memory 191 through the ADC 182. The operation with reference to FIG. 11*a* is similar to that with reference to FIG. 7*c*, except that the first transistor M1 is further turned-on during a period of sensing degradation information of the organic light emitting diode OLED.

Similarly, as shown in FIG. 11*b*, during the period of extracting the degradation information of the organic light emitting diode OLED, operation is similar to that described above except that the scan signal is supplied to the scan line Sn when the control signal is supplied to the control line CLn.

As described above, in the organic light emitting display, a second data may be generated using the degradation information of the organic light emitting diode OLED and the threshold voltage and/or mobility information of the drive transistor M2. Therefore, the display may display uniform images having desired luminance regardless of the degradation of the organic light emitting diode OLED and variation in a threshold voltage or mobility of the drive transistor M2.

Figure 12:
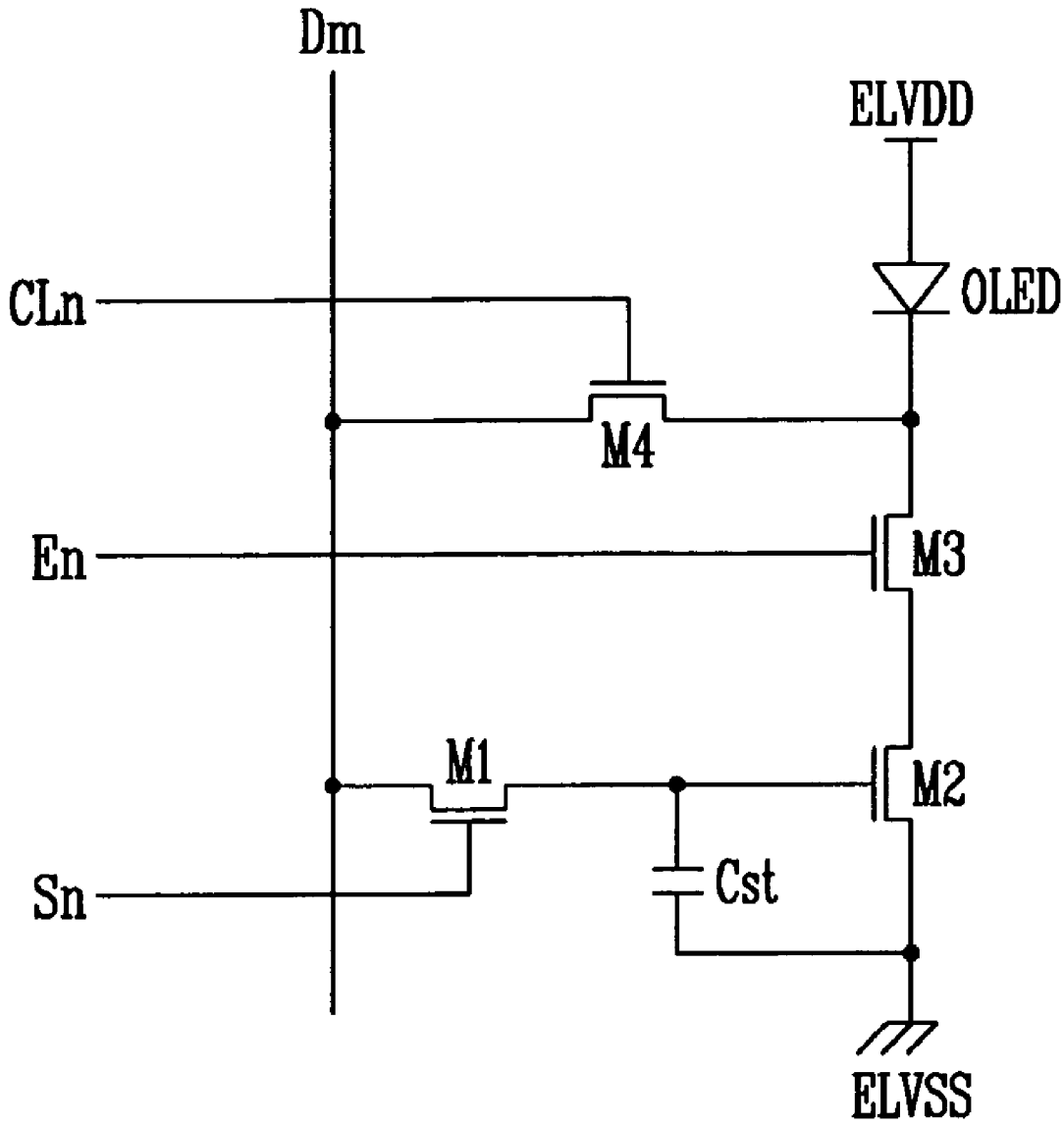
FIG. 12 is a circuit diagram showing another embodiment of a pixel.

In the embodiment described herein all transistors included in the pixels 140 are a PMOS transistor. However, the present invention is not limited thereto. For example, all transistors M1 to M4 included in the pixel 140 as shown in FIG. 12 can be NMOS transistors. FIG. 12 is a circuit diagram showing another embodiment of the pixel shown in FIG. 2.

As shown in FIG. 12, the first transistor M1 is coupled with the scan line Sn and the data line Dm. When a scan signal is supplied to the scan line Sn, the first transistor M1 is turned on. When the first transistor M1 is turned-on, the storage capacitor Cst is charged with a predetermined voltage corresponding to a data signal, which is supplied to the data line Dm. The second transistor M2 controls an electric current corresponding to the voltage charged in the storage capacitor Cst to flow through the organic light emitting diode OLED. The third transistor M3 is disposed between the second transistor M2 and the organic light emitting diode OLED. When the emission control signal is supplied, the third transistor M3 is turned off. The fourth transistor M4 is disposed between a cathode electrode of the organic light emitting diode OLED and the data line Dm. When a control signal is supplied to a control line CLn, the fourth transistor M4 is turned-on.

When the transistors M1 to M4 are NMOS transistors, a drive waveform is opposite to the case of the PMOS transistor.

As seen from the forgoing description, in the organic light emitting display and a method for driving the same, the threshold voltage and/or mobility information of a drive transistor is stored while a first electric current from a pixel is sunk. Further, degradation information of an organic light emitting diode is stored while supplying a second electric current to the pixel. In addition, a second data is generated using the stored information so that variation in the threshold voltage and/or mobility of a drive transistor and the degradation of an organic light emitting diode can be compensated for. Therefore, the display may display images of uniform luminance regardless of a shift in threshold voltage and/or mobility of the drive transistor and the degradation of an organic light emitting diode.

Although a few embodiments have been shown and described, it would be appreciated by those skilled in the art that changes might be made without departing from the principles and spirit of the invention.

What is claimed is:

1. An organic light emitting display, comprising:

a plurality of pixels disposed near intersections of data lines, scan lines, and emission control lines, each pixel comprising:

an organic light emitting diode, and a transistor configured to provide current to the organic light emitting diode;

a scan driver configured to supply a scan signal to the scan lines and to supply an emission control signal to the emission control lines;

a control line driver configured to supply a control signal to control lines;

a data driver configured to generate data signals for the data lines;

a sensing unit configured to:

sense degradation information of a selected one of the organic light emitting diodes in a first operation, and sense degradation information of a threshold voltage and/or mobility information of the transistor that provides current to the selected organic light emitting diode in a second operation, wherein the first and second operations are separate in time;

a switch unit configured to connect one of the sensing unit and the data driver to the data lines;

a control block configured to store the sensed degradation information and the sensed threshold voltage and/or mobility information; and a timing controller configured to generate second data based on first data from another circuit, the sensed degradation information, and the sensed threshold voltage and/or mobility information.

2. The organic light emitting display as claimed in claim 1, wherein the sensing unit includes:

a sensing circuit for each channel;

an analog-digital converter configured to convert the sensed threshold voltage and/or mobility information and the sensed degradation information from the sensing circuit into a first digital value and a second digital value, respectively.

3. An organic light emitting display, comprising:

a plurality of pixels disposed near intersections of data lines, scan lines, and emission control lines;

a scan driver configured to supply a scan signal to the scan lines and to supply an emission control signal to the emission control lines;

a control line driver configured to supply a control signal to control lines;

a data driver configured to generate data signals for the data lines;

a sensing unit configured to sense degradation information of an organic light emitting diode and a and threshold voltage and/or mobility information of a drive transistor included in each of the pixels;

a switch unit configured to connect one of the sensing unit and the data driver to the data lines;

a control block configured to store the sensed degradation information and the sensed threshold voltage and/or mobility information; and a timing controller configured to generate second data based on first data from another circuit, the sensed degradation information, and the sensed threshold voltage and/or mobility information, wherein the sensing unit includes:

a sensing circuit for each channel;

an analog-digital converter configured to convert the sensed threshold voltage and/or mobility information and the sensed degradation information from the sensing circuit into a first digital value and a second digital value, respectively, and wherein the sensing circuit includes:

a current sink unit configured to sink a first electric current from the pixel; and a current source unit configured to supply a second electric current to the pixel.

4. The organic light emitting display as claimed in claim 3, wherein the switch unit includes three switching elements for each channel, wherein the three switching elements include:

a third switching element disposed between the current sink unit and the data line, the third switching element configured to be turned on when the threshold voltage information is sensed;

a second switching element disposed between the current source unit and the data, the second switching element configured to be turned on when the degradation information is sensed; and a first switching element disposed between the data driver and the data line, the first switching element configured to be turned on when the data signal is supplied.

5. The organic light emitting display as claimed in claim 4, wherein the control block includes:

a memory configured to store the first digital value and the second digital value; and a controller configured to transfer the first digital value and the second digital value to the timing controller.

6. The organic light emitting display as claimed in claim 5, wherein the controller of the control block is configured to transfer the first digital value and the second digital value for a certain pixel to the timing controller when the first data for the certain pixel is input to the timing controller.

7. The organic light emitting display as claimed in claim 5, wherein the timing controller generates the second data based at least in part on the first data and the second data has a greater number of bits than the first data.

8. The organic light emitting display as claimed in claim 7, wherein the second data compensates for at least one of degradation of the organic light emitting diode and variation of the threshold voltage and/or mobility of the drive transistor.

9. The organic light emitting display as claimed in claim 5, wherein each of the pixels includes:

the organic light emitting diode;

a first transistor coupled with the scan line and the data line, the first transistor configured to be turned on when a scan signal is supplied to the scan line;

a storage capacitor configured to be charged with a voltage corresponding to the data signal supplied to the data line;

a second transistor configured to supply an electric current corresponding to the voltage stored in the storage capacitor to the organic light emitting diode;

a third transistor between the second transistor and the organic light emitting diode, the third transistor configured to be turned off when an emission control signal is supplied to the emission control line; and a fourth transistor between an anode electrode of the organic light emitting diode and the data line, the fourth transistor configured to be turned on when a control signal is supplied to the control line.

10. The organic light emitting display as claimed in claim 9, wherein the first transistor, the third transistor, and the fourth transistor are turned on when the threshold voltage and/or mobility information is sensed.

11. The organic light emitting display as claimed in claim 10, wherein the first voltage generated when the first current is sunk is converted into the first digital value.

12. The organic light emitting display as claimed in claim 10, wherein sensing of the threshold voltage and/or mobility information is performed at least once prior to the distribution of the organic light emitting display.

13. The organic light emitting display as claimed in claim 10, wherein a cathode voltage of the organic light emitting diode is increased when the threshold voltage and/or mobility information is sensed.

14. The organic light emitting display as claimed in claim 9, wherein the fourth transistor is turned on when the degradation information of the organic light emitting diode is sensed.

15. The organic light emitting display as claimed in claim 14, wherein the second voltage generated when the second electric current is supplied to the organic light emitting diode is converted into the second digital value.

16. The organic light emitting display as claimed in claim 15, wherein the degradation information of the organic light emitting diode is sensed at least once when power is supplied to the organic light emitting display.

17. The organic light emitting display as claimed in claim 15, wherein the degradation information of the organic light emitting diode is sensed before the data signal is supplied to the pixel.

18. The organic light emitting display as claimed in claim 9, wherein the fourth transistor maintains an off state while a data signal is supplied to the storage capacitor and the organic light emitting diode emits light.

19. The organic light emitting display as claimed in claim 5, wherein each of the pixels includes:

the organic light emitting diode;

a first transistor coupled with the scan line and the data line, the first transistor configured to be turned on when a scan signal is supplied to the scan line;

a storage capacitor configured to be charged with a voltage corresponding the data signal supplied to the data line;

a second transistor configured to supply an electric current corresponding to the voltage stored in the storage capacitor to the organic light emitting diode;

a third transistor between the second transistor and the organic light emitting diode, the third transistor configured to be turned off when an emission control signal is supplied to the emission control line; and a fourth transistor between an anode electrode of the organic light emitting diode and the gate electrode of the drive transistor, the fourth transistor configured to be turned on a control signal is supplied to the control line.

20. The organic light emitting display as claimed in claim 19, wherein the first transistor, the third transistor, and the fourth transistor are turned-on when the threshold voltage and/or mobility information is sensed.

21. The organic light emitting display as claimed in claim 20, wherein a cathode voltage of the organic light emitting diode is increased when the threshold voltage is sensed.

22. The organic light emitting display as claimed in claim 20, wherein the first transistor and fourth transistor are turned on when the degradation information of the organic light emitting diode is sensed.

23. The organic light emitting display as claimed in claim 20, wherein the fourth transistor maintains an off state while a data signal is supplied to the storage capacitor and the organic light emitting diode emits light.

24. An organic light emitting display, comprising:

a plurality of pixels disposed near intersections of data lines, scan lines, and emission control lines;

a scan driver configured to supply a scan signal to the scan lines and to supply an emission control signal to the emission control lines;

a control line driver configured to supply a control signal to control lines;

a data driver configured to generate data signals for the data lines;

a sensing unit configured to sense degradation information of an organic light emitting diode and a and threshold voltage and/or mobility information of a drive transistor included in each of the pixels;

a switch unit configured to connect one of the sensing unit and the data driver to the data lines;

a control block configured to store the sensed degradation information and the sensed threshold voltage and/or mobility information; and a timing controller configured to generate second data based on first data from another circuit, the sensed degradation information, and the sensed threshold voltage and/or mobility information, wherein each of the pixels includes:

the organic light emitting diode;

a first NMOS transistor coupled with the scan line and the data line, the first NMOS transistor configured to be turned on when a scan signal is supplied to the scan line;

a storage capacitor configured to be charged with a voltage corresponding the data signal supplied to the data line;

a second NMOS transistor configured to control an electric current through the organic light emitting diode, the current corresponding to a voltage stored in the storage capacitor;

a third NMOS transistor located between the second transistor and the organic light emitting diode, the third transistor configured to be turned off when an emission control signal is supplied to the emission control line; and a fourth NMOS transistor located between an anode electrode of the organic light emitting diode and the data line, the fourth transistor configured to be turned on when a control signal is supplied to the control line.

25. The organic light emitting display as claimed in claim 7, wherein the data driver includes:

a shift register unit configured to sequentially generate a sampling signal;

a sampling latch unit configured to sequentially store the second data according to the sampling signal;

a holding latch unit configured to temporarily store the second data stored in the sampling latch;

a signal generator configured to generate data signals based on the second data stored in the holding latch unit; and a buffer unit configured to transfer the data signals to the data line when the first switching element is turned on.

26. A method of driving an organic light emitting display, the method comprising:

supplying a data signal to each of a plurality of pixels connected to a plurality of data lines, each pixel comprising an organic light emitting diode and a transistor configured to provide current to the organic light emitting diode;

sensing degradation information of a threshold voltage and/or mobility information of the transistor that provides current to the selected organic light emitting diode in a first operation, sensing degradation information of a selected one of the organic light emitting diodes in a second operation, wherein the first and second operations are separate in time, and generating a next data signal for the pixels based in part on the sensed degradation information of the separate first and second operations.

27. The method according to claim 26, further comprising:

generating during the first operation a first voltage while sinking a first electric current through a drive transistor in a selected one of a plurality of pixels;

converting the first voltage into a first digital value;

storing the first digital value in a memory;

generating during the second operation a second voltage while supplying a second electric current to an organic light emitting diode in the selected pixel;

converting the second voltage into a second digital value;

storing the second digital value in the memory; and generating second data based on first data received from another circuit, the first digital value and the second digital value, wherein the second data has more bits than the first data value.

28. The method as claimed in claim 27, wherein the second data is generated by adjusting a value of the first data in order to compensate for at least one of a variation in threshold voltage of the drive transistor, a variation in the mobility of the drive transistor, and a degradation of the organic light emitting diode.

29. The method as claimed in claim 27, further comprising:

generating a data signal using the second data; and supplying the data signal to the pixel to generate light based on the data signal.

30. The method as claimed in claim 27, wherein generating and converting the first voltage are performed at least once prior to selling the display.

31. The method as claimed in claim 27, wherein generating and converting the second voltage are performed at least once when power is supplied to the organic light emitting display.

32. The method as claimed in claim 27, wherein generating and converting the second voltage are performed before a data signal is supplied to the pixel.

* * * * *